US011621465B2

(12) United States Patent
Lee et al.

(10) Patent No.: US 11,621,465 B2
(45) Date of Patent: Apr. 4, 2023

(54) CIRCULATOR-BASED TUNABLE DELAY LINE

(71) Applicant: International Business Machines Corporation, Armonk, NY (US)

(72) Inventors: Wooram Lee, Briarcliff Manor, NY (US); Alberto Valdes Garcia, Chappaqua, NY (US)

(73) Assignee: International Business Machines Corporation, Armonk, NY (US)

( * ) Notice: Subject to any disclaimer, the term of this patent is extended or adjusted under 35 U.S.C. 154(b) by 267 days.

(21) Appl. No.: 16/896,919

(22) Filed: Jun. 9, 2020

(65) Prior Publication Data

US 2021/0384597 A1 Dec. 9, 2021

(51) Int. Cl.

| | |
|---|---|
| ***H01P 1/38*** | (2006.01) |
| ***H01Q 3/36*** | (2006.01) |
| ***H01P 1/18*** | (2006.01) |

(52) U.S. Cl.

CPC ..... *H01P 1/38* (2013.01); *H01P 1/18* (2013.01); *H01Q 3/36* (2013.01)

(58) Field of Classification Search

CPC ..... H01P 1/38; H01P 1/18; H01Q 3/36

See application file for complete search history.

(56) References Cited

U.S. PATENT DOCUMENTS

| | | | | |
|---|---|---|---|---|
| 4,701,714 A | | 10/1987 | Agoston | |
| 5,307,031 A | * | 4/1994 | Dick | H03H 11/16 333/156 |
| 9,660,625 B1 | | 5/2017 | Lee et al. | |
| 9,813,264 B2 | | 11/2017 | Ding et al. | |
| 2009/0251368 A1 | * | 10/2009 | McCune, Jr. | H01Q 3/38 342/368 |
| 2015/0207491 A1 | | 7/2015 | Bao et al. | |
| 2017/0093384 A1 | | 3/2017 | Shin et al. | |

(Continued)

FOREIGN PATENT DOCUMENTS

| | | | |
|---|---|---|---|
| JP | 11122013 | * | 4/1999 |
| JP | 2006174190 A | * | 6/2006 |
| WO | 2018144075 A1 | | 8/2018 |

OTHER PUBLICATIONS

Jang, S., et al., "A 1-GHz 16-Element Four-Beam True-Time-Delay Digital Beamformer", IEEE Journal of Solid-State Circuits, May 2019, pp. 1305-1314, vol. 54, No. 5.

(Continued)

*Primary Examiner* — Ryan Jager

(74) *Attorney, Agent, or Firm* — Scully, Scott, Murphy & Presser, P.C.; Daniel P. Morris.

(57) ABSTRACT

Systems and methods for delaying an input signal are described. A device can receive an input signal. The device can activate a state of at least one circuit element among a plurality of circuit elements. The plurality of circuit elements can be connected to a plurality of segments of a transmission line. The device can output the input signal to the transmission line. The device can receive a reflection of the input signal. A delay between the reflection and input signal can be based on the activated state of the at least one circuit element among the plurality of circuit elements. The device can output the reflection of the input signal as an output signal.

16 Claims, 8 Drawing Sheets

(56) References Cited

U.S. PATENT DOCUMENTS

| | | | |
|---|---|---|---|
| 2019/0020088 | A1 | 1/2019 | Huettner et al. |
| 2019/0312620 | A1 | 10/2019 | Coutts |

OTHER PUBLICATIONS

Tousi, Y., et al., "A Ka-band Digitally-Controlled Phase Shifter with sub-degree Phase Precision", 2016 IEEE Radio Frequency Integrated Circuits Symposium, Date of Conference: May 22-24, 2016, pp. 356-359, Conference Location: San Francisco, CA.

Garakoui, S., K., et al. "Phased-Array Antenna Beam Squinting Related to Frequency Dependency of Delay Circuits", Proceedings of the 8th European Radar Conference, Oct. 12-14, 2011, 4 pages, Manchester, UK.

Roderick, J., et al., "Silicon-Based Ultra-Wideband Beam-Forming", IEEE Journal of Solid-State Circuits, Aug. 2006, pp. 1727-1739, vol. 41, No. 8.

* cited by examiner

100

500

CIRCULATOR-BASED TUNABLE DELAY LINE

BACKGROUND

The present disclosure relates in general to delay lines that can be implemented as phase shifters in communication systems and devices.

Communication systems and devices having antenna arrays can include phase shifters and/or time delay units to form transmit and/or receive beams and control their direction. The phase shifter can provide phase delays to perform beam forming and steering. The time delay unit can include delay lines (e.g., transmission lines) that provide time delay instead of phase delay. These time delay units can provide linear phase change proportional to delay, along frequencies within the bandwidth of the signal being transmitted or received.

SUMMARY

In some examples, a structure for delaying a signal is generally described. The structure can include a circulator, a transmission line, and a plurality of circuit elements. The transmission line can be connected to the circulator. The transmission line can have a plurality of segments. The plurality of circuit elements can be connected to the plurality of segments. The circulator can be configured to receive an input signal. The circulator can be further configured to output an output signal. A delay between the input signal and the output signal can be based on at least one control signal being applied on at least one circuit element among the plurality of circuit elements.

In some examples, a system for delaying a signal is generally described. The system can include a first device and a second device configured to be in communication with the first device. The second device can include a plurality of structures. A structure can include a circulator, a transmission line, and a plurality of circuit elements. The transmission line can be connected to the circulator. The transmission line can have a plurality of segments. The plurality of circuit elements can be connected to the plurality of segments. The circulator can be configured to receive an input signal from the first device. The circulator can be further configured to output an output signal. A delay between the input signal and the output signal can be based on at least one control signal being applied on at least one circuit element among the plurality of circuit elements.

In some examples, a method for delaying an input signal is generally described. The method can include receiving an input signal. The method can further include activating a state of at least one circuit element among a plurality of circuit elements connected to a plurality of segments of a transmission line. The method can further include outputting the input signal to the transmission line. The method can further include receiving a reflection of the input signal. A delay between the reflection and input signal can be based on the activated state of the at least one circuit element among the plurality of circuit elements. The method can further include outputting the reflection of the input signal as an output signal.

Further features as well as the structure and operation of various embodiments are described in detail below with reference to the accompanying drawings. In the drawings, like reference numbers indicate identical or functionally similar elements.

DETAILED DESCRIPTION

Phase shifters in an active antenna array architecture can steer a beam, but may not provide true time delay over a wide bandwidth. Due to the lack of true time delay, utilizing phase shifters to transmit an ultra-wideband (UWB) signal can cause beam squinting (e.g., the beam can distort or squint over frequency) and array inter-symbol interference that can limit signal bandwidth. Time delay units can be used to mitigate beam squinting. In some examples, time delay can be accomplished by using a length of transmission line, such as coax cables, fiber optic delay lines, microstrip lines, strip lines, coplanar lines, or other types of transmission lines. In some examples, communication and radar systems can use delay lines to perform signal analysis on a large number of acquired pulses by delaying some of the pulses in time. Delay lines can be implemented as analog circuits, digital circuits, or as mechanical structures.

Figure 1:
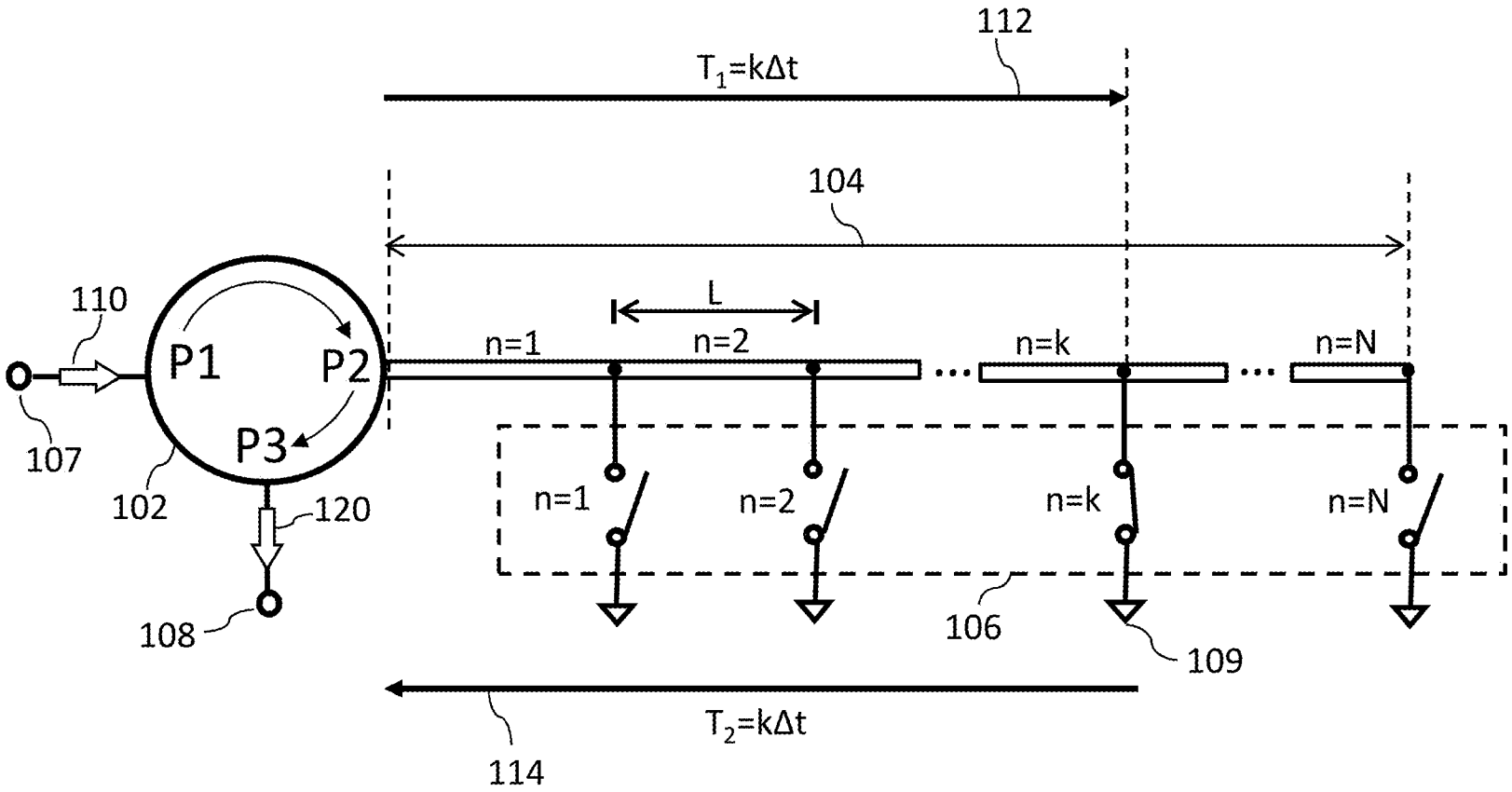
FIG. 1 is a diagram showing an example of a circulator-based tunable delay line in one embodiment.

FIG. 1 is a diagram showing an example of a circulator-based tunable delay line in one embodiment. A structure 100 can be a time delay unit or structure implemented in a communication system or communication device. For example, the structure 100 can be implemented with a transmitter, a receiver, or a transceiver. In some examples, the structure 100 can be implemented as a part of a phase shifting apparatus with a communication device. The structure 100 can include a circulator 102, a transmission line 104, and a plurality of circuit elements 106. The circulator 102 can be a non-reciprocal device that can be implemented in a passive or active architecture, such as a three-port circulator device including a first port labeled as P1, a second port labeled as P2, and a third port labeled as P3. A signal applied to port P1 can be outputted by port P2, a signal applied to port P2 can be outputted by the port P3, and a signal applied to port P3 can be outputted by the port P1. In the example embodiment shown in FIG. 1, the circuit elements 106 can include a plurality of shunt switches or switches (e.g., N switches) ranging from n=1 to n=N. The transmission line 104 can include a plurality of segments 105 (e.g., N segments) ranging from n=1 to n=N. Each circuit element or switch 106 can be connected to a respective segment 105 of the transmission line 104. The plurality of circuit elements or switches 106 can be connected to ground (or ground terminal) 109.

In the example shown in FIG. 1, the port P1 can be connected to a terminal 107, where the terminal 107 can be connected to a source that provides an input signal 110. The signal 110 can be received at port P1, and can be circulated to P2 such that the signal 110 can be outputted at the port P2 to the transmission line 104. The signal 110 can flow or propagate along the transmission line 104 in a first direction 112. In an example, a $k^{th}$ switch (e.g., n=k) among the N circuit elements 106 can be activated. The activation of the $k^{th}$ switch can form a closed signal path between the circulator 102 and the $k^{th}$ segment, where the formed closed signal path can have a length of k segments. The signal 110 can be reflected from the $k^{th}$ segment and propagate towards the circulator 102 in a direction 114. The reflection of the signal 110 can be received by the port P2 and can be outputted at the port P3 as an output signal 120, where the output signal 120 is a delayed version of the signal 110. The output signal 120 can be outputted to another component or device via a terminal 108 connected to the port P3.

In the example shown in FIG. 1, each segment 105 can have the same unit length L, where the value of L is proportional to a delay Δt of a signal propagating through a segment 105. For example, the signal 110 propagating from the port P2 to the $k^{th}$ segment in the direction 112 can experience a delay of $T_1=k\Delta t$. Similarly, the reflection of the signal 110 propagating from the $k^{th}$ segment to the port P2 in the direction 114 can experience a delay of $T_2=k\Delta t$. The total delay of the signal 110, or the delay between the output signal 120 and the input signal 110, can be denoted as T, where $T=T_1+T_2=2k\Delta t$. The structure 100 can utilize reflection topology (e.g., reflection of the signal 110 by activating switches) to provide a maximum delay corresponding to two times the total length of the transmission line 104 while keeping broadband characteristics of transmission lines. Further, in some examples, one switch among the circuit elements 106 can be activated at a time to minimize loss and power consumption.

Furthermore, the structure 100 can use less area while doubling the delay on a signal, when compared to another structure that may not implement a circulator with a transmission line of the same length L. For example, if the transmission line 104 is implemented without the circulator 102, a maximum delay of NΔt can be achieved, but the implementation of the circulator 102 with the transmission line 104 can achieve a maximum delay of 2NΔt. Without the circulator 102, two pieces of transmission line 104 may be needed to achieve a maximum delay of 2NΔt and the two pieces of transmission line 104 can occupy larger area than a combination of the circulator 102 and one piece of transmission line 104. In addition to this area advantage, the structure 100 can enable time delay programmability through circuit elements 106. In some examples, without the circulator 102 and the circuit elements 106, two pieces of transmission line 104 can introduce a fixed delay.

Figure 2:
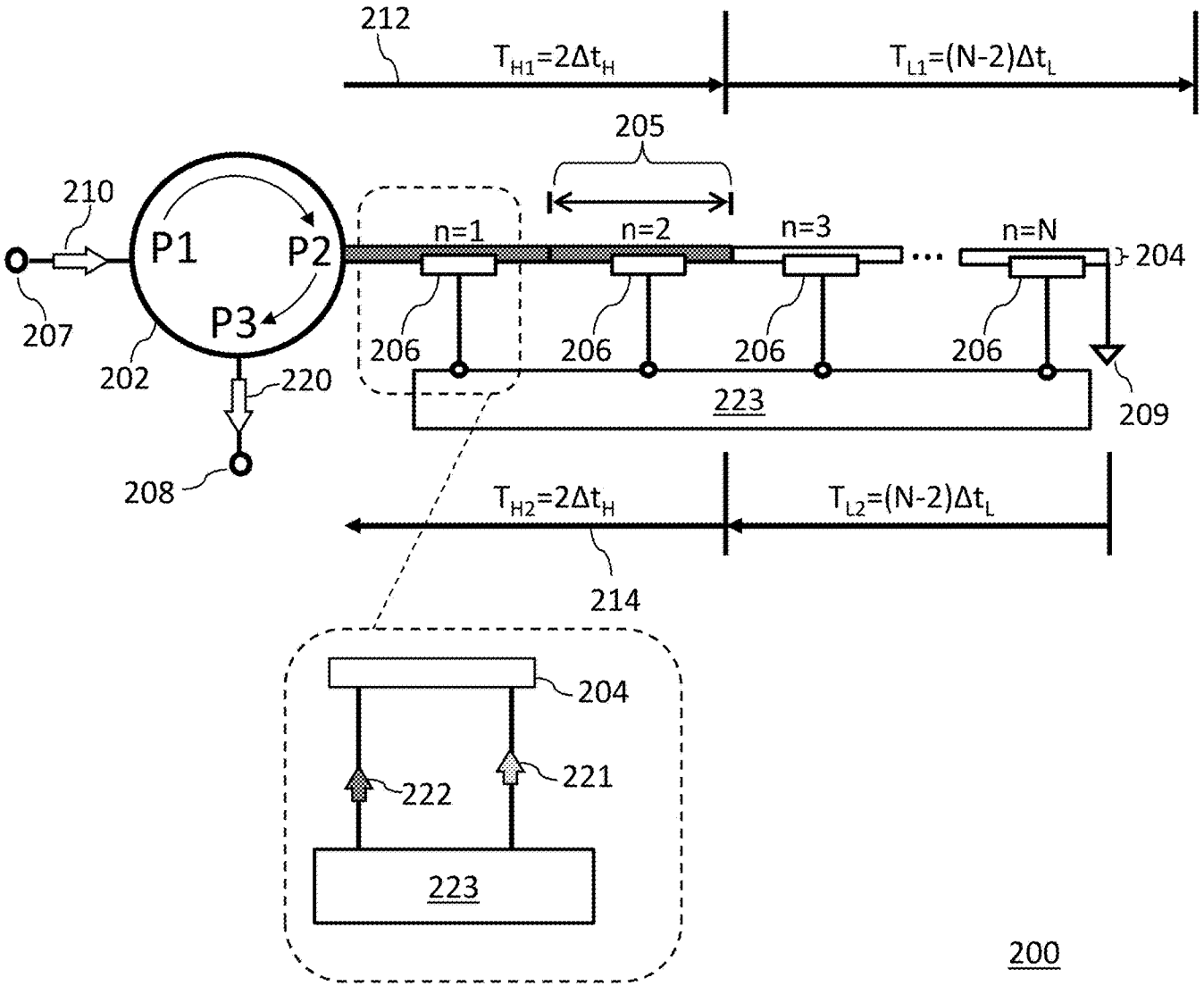
FIG. 2 is a diagram showing an example of a circulator-based tunable delay line in another embodiment.

FIG. 2 is a diagram showing an example of a circulator-based tunable delay line in another embodiment. A structure 200 can be a time delay unit or structure implemented in a communication system or communication device. For example, the structure 200 can be implemented with a transmitter, a receiver, or a transceiver. In some examples, the structure 200 can be implemented as a part of a phase shifting apparatus with a communication device. The structure 200 can include a circulator 202, a transmission line 204, a plurality of circuit elements 206, and a controller 223. The circulator 202 can be a non-reciprocal device that can be implemented in a passive or active architecture, such as a three-port circulator device including a first port labeled as P1, a second port labeled as P2, and a third port labeled as P3. A signal applied to port P1 can be outputted by port P2, a signal applied to port P2 can be outputted by the port P3, and a signal applied to port P3 can be outputted by the port P1. In the example embodiment shown in FIG. 2, the plurality of circuit elements 206 can include N circuit elements ranging from n=1 to n=N. The transmission line 204 can include a plurality of segments 205 (e.g., N segments) ranging from n=1 to n=N. Each circuit element 206 can be connected to a respective segment 205 of the transmission line 204. The transmission line 204 can be connected to ground (or ground terminal) 209 or can be terminated with a short-end at the opposite end from port P2.

In the example shown in FIG. 2, the port P1 can be connected to a terminal 207, where the terminal 207 can be connected to a source that provides an input signal 210. The signal 210 can be received at port P1, and can be circulated to P2 such that the signal 210 can be outputted at the port P2 to the transmission line 204. The signal 210 can flow or propagate along the transmission line 204 in a direction 212. The signal 210 can be reflected from the last segment 205 (segment 205 at n=N) connected to ground 209 and propagate towards the circulator 202 in another direction 214. The reflection of the signal 210 can be received by the port P2 and can be outputted at the port P3 as an output signal 220, where the output signal 220 is a delayed version of the signal 210. The output signal 220 can be outputted to another component or device via a terminal 208 connected to the port P3.

In the example shown in FIG. 2, each segment 205 can have the same unit length L, where the value of L is proportional to a delay of a signal propagating through a segment 205. The segments 205 can be identical, and can be programmable with two different delay states. This programmability can be achieved through circuit elements 206 and controller 223. For example, the circuit elements 206 shown in FIG. 2 can delay a signal propagating through a corresponding segment 205 at two different levels—a high delay state and a low delay state. In an example, regardless of its delay state, the characteristic impedance of the segments 205 can be kept constant to avoid any reflection between two segments (among segments 205) having different delay states. In an example the delay programmability is realized by changing the line inductance and line capacitance of the transmission line segment 205. In this example a high line and inductance and high line capacitance correspond to a high delay state whereas a low line inductance and low line capacitance correspond to a low delay state.

In an example, when a high delay state of a $k^{th}$ (n=k) segment 205 is activated, the $k^{th}$ segment 205 can introduce a delay $\Delta t_H$ on the signal propagating through the $k^{th}$ segment. Similarly, when a low delay state of a $k^{th}$ (n=k) segment 205 is activated, the $k^{th}$ segment 205 can introduce a delay $\Delta t_L$ on the signal propagating through the $k^{th}$ segment, where the delay $\Delta t_H$ is greater than the delay $\Delta t_L$.

In the example shown in FIG. 2, the circuit elements 206 at n=1 and n=2 can be activated to the high delay state, and the circuit elements 206 from n=3 to n=N can be activated to the low delay state. The signal 210 propagating from the port P2 up to the segment 205 at n=2, in the direction 212, can experience a delay of $T_{H1}=2\Delta t_H$. The signal 210 propagating from the segment 205 at n=3 to the ground 209, in the direction 212, can experience a delay of $T_{L1}=(N-2)\Delta t_L$. The signal 210 propagating from the port P2 to the ground 209 can experience a one-way delay of $T_1=T_{H1}+T_{L1}=2\Delta t_H+(N-2)\Delta t_L$.

The signal 210 can be reflected to propagate from the ground 209 towards port P2 of the circulator 202. The reflection of the signal 210 propagating from the ground to the segment 205 at n=3, in the direction 214, can experience a delay of $T_{L2}=(N-2)\Delta t_L$. The reflection of the signal 210 propagating from the segment 205 at n=2 to the port P2, in the direction 214, can experience a delay of $T_{H2}=2\Delta t_H$. The reflection of the signal 210 propagating from the ground 209 to the port P2, in the direction 214, can experience a one-way delay of $T_2=T_{H2}+T_{L2}=2\Delta t_H+(N-2)\Delta t_L$. The total roundtrip delay of the signal 210, or the delay between the output signal 220 and the signal 210, can be $T=T_1+T_2=44t_H+2(N-2)\Delta t_L$.

If k segments 205 are activated to the high delay state, and N−k segments 205 are activated to the low delay state, the total delay between the output signal 220 and the signal 210 can be represented as $T=2k\Delta t_H+2(N-k)\Delta t_L$. Different number of segments 205 being activated to the high delay state or the low delay state can tune or refine the delay being introduced to the signal 210 propagating along the transmission line 204 at different levels. For example, increasing the number of segments 205 activated to the high delay state can increase the total delay between the output signal 220 and the signal 210. In an example, having the N segments 205 activated to the high delay state can introduce a maximum delay $T=2N\Delta t_H$ to the signal 210, and having the N segments 205 activated to the low delay state can introduce a delay of $T=2N\Delta t_L$ to the signal 210. The total delay tuning range can be $2N(\Delta t_H-\Delta t_L)$.

The controller 223 can be configured to generate control signals to activate the circuit elements 206 in order to set the transmission line section 205 in either the high delay state or the low delay state. The controller 223 can generate and output control signals 221 and 222. The control signal 221 can be a control signal to activate a first state of a circuit element 206 to set a corresponding segment 205 to a low delay state, and the control signal 222 can be a control signal to activate a second state of the circuit element 206 to set the corresponding segment 205 to a high delay state. In an example embodiment, the transmission line section 205 can be a strip line circuit including a signal line, a first set of ground lines, and a second set of ground lines. The control signal 221 can be applied to activate the first set of ground lines to activate the first state of the circuit elements 206 to set corresponding segments 205 to the low delay state, and the control signal 222 can be applied to activate the second set of ground lines to activate the second state of the circuit elements 206 to set corresponding segments 205 to the high delay state. In another example, the circuit element 206 includes a capacitor with one terminal connected to the transmission line section 205 and another terminal connected to a switch to ground. In this example the control signal 222 can activate the switch, effectively connecting the second capacitance terminal to ground.

Figure 3:
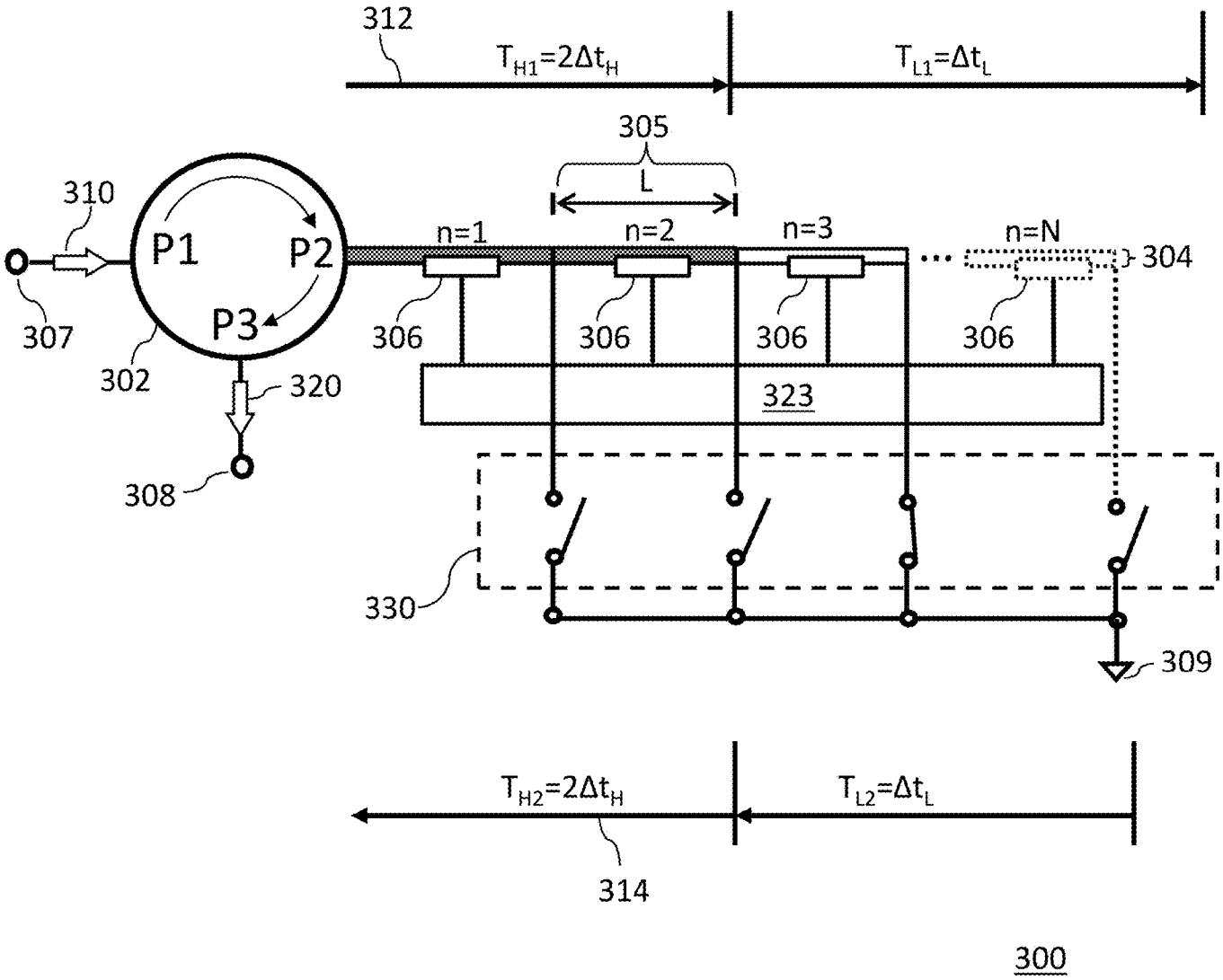
FIG. 3 is a diagram showing an example of a circulator-based tunable delay line in another embodiment.

FIG. 3 is a diagram showing an example of a circulator-based tunable delay line in another embodiment. A structure 300 can be a time delay unit or structure implemented in a communication system or communication device. For example, the structure 300 can be implemented with a transmitter, a receiver, or a transceiver. In some examples, the structure 100 can be implemented as a part of a phase shifting apparatus with a communication device. The structure 300 can include a circulator 302, a transmission line 304, a plurality of circuit elements 306, a controller 323, and a plurality of switches 330. The circulator 302 can be a non-reciprocal device that can be implemented in a passive or active architecture, such as a three-port circulator device including a first port labeled as P1, a second port labeled as P2, and a third port labeled as P3. A signal applied to port P1 can be outputted by port P2, a signal applied to port P2 can be outputted by the port P3, and a signal applied to port P3 can be outputted by the port P1. In the example embodiment shown in FIG. 3, the plurality of circuit elements 306 can include N circuit elements ranging from n=1 to n=N. The plurality of switches 330 can include N switches ranging from n=1 to n=N. The transmission line 304 can include a plurality of segments 305 (e.g., N segments) ranging from n=1 to n=N. Each circuit element 306 can be connected to a respective segment 305 of the transmission line 304, and to a respective switch 330. The plurality of switches 330 can be connected to ground (or ground terminal) 309.

In the example shown in FIG. 3, each segment 305 can have the same unit length L, where the value of L is proportional to a delay of a signal propagating through a segment 305. The circuit elements 306 shown in FIG. 3 can delay a signal propagating through a corresponding segment 305 at two different levels—a high delay level and a low delay level. In an example, when a high delay state of a $k^{th}$ (n=k) segment 305 is activated, the $k^{th}$ segment 305 can introduce a delay $\Delta t_H$ on the signal propagating through the $k^{th}$ segment. Similarly, when a low delay state of a $k^{th}$ (n=k) segment 305 is activated, the $k^{th}$ segment 305 can introduce a delay $\Delta t_L$ on the signal propagating through the $k^{th}$ segment, where the delay $\Delta t_H$ is greater than the delay $\Delta t_L$.

In the example shown in FIG. 3, the port P1 can be connected to a terminal 307, where the terminal 307 can be connected to a source that provides an input signal 310. The signal 310 can be received at port P1, and can be circulated to P2 such that the signal 310 can be outputted at the port P2 to the transmission line 304. The signal 310 can flow or propagate along the transmission line 304 in a direction 312. A switch at n=3 among the N switches 330 can be activated. The activation of the switch at n=3 can form a closed signal path between the circulator 302 and the segment 305 at n=3, where the formed closed signal path can have a length of three times the unit length L (3L). The signal 310 can be reflected from the segment 305 at n=3 and propagate towards the circulator 102 in a direction 314. The reflection of the signal 310 can be received by the port P2 and can be outputted at the port P3 as an output signal 320, where the output signal 320 is a delayed version of the signal 310. The output signal 320 can be outputted to another component or device via a terminal 308 connected to the port P3.

Further, in the example shown in FIG. 3, the segments 305 at n=1 and n=2 can be activated to the high delay state, and the segments 305 from n=3 to n=N can be activated to the low delay state. The activation of the switch 330 at n=3 can cause the signal 310 propagating from the port P2 up to the segment 305 at n=2, in the direction 312, to experience a delay of $T_{H1}=2\Delta t_H$. The signal 310 propagating through the segment 305 at n=3, in the direction 312, can experience a delay of $T_{L1}=\Delta t_L$. Note that no further delays may be experienced by the signal 310 in the direction 312 as the activation of the switch 330 at n=3 causes the signal 310 to be reflected towards the circulator 302. The signal 310 propagating from the port P2 to the segment 305 at n=3 can experience a one-way delay of $T_1=T_{H1}+T_{L1}=2\Delta t_H\ \Delta t_L$.

The signal 310 can be reflected to propagate from the segment 305 at n=3 towards port P2 of the circulator 302. The reflection of the signal 310 propagating through the segment 305 at n=3, in the direction 314, can experience a delay of $T_{L2}=\Delta t_L$. The reflection of the signal 310 propagating from the segment 205 at n=2 to the port P2, in the direction 314, can experience a delay of $T_{H2}=2\Delta t_H$. The reflection of the signal 310 propagating from the segment 305 at n=3 to the port P2, in the direction 314, can experience a one-way delay of $T_2=T_{H2}+T_{L2}+T_{L2}=2\Delta t_H+\Delta t_L$. The total roundtrip delay of the signal 310, or the delay between the output signal 320 and the signal 310, can be $T=T_1+T_2=4\Delta t_H+2\Delta t_L$.

The example embodiment shown in FIG. 3 can provide relatively coarser tuning to the delay of an input signal by selecting a switch 330 for activation, and also provide finer tuning by toggling the circuit elements 306 between high and low delay states. The controller 323 shown in FIG. 3 can operate in a similar manner as the controller 223 shown in FIG. 2, the circuit elements 306 can in FIG. 3 can operate in a similar manner as the circuit elements 206 shown in FIG. 2, and the switches 330 can operate in a similar manner as the switches or circuit element 106 shown in FIG. 1.

Figure 4A:
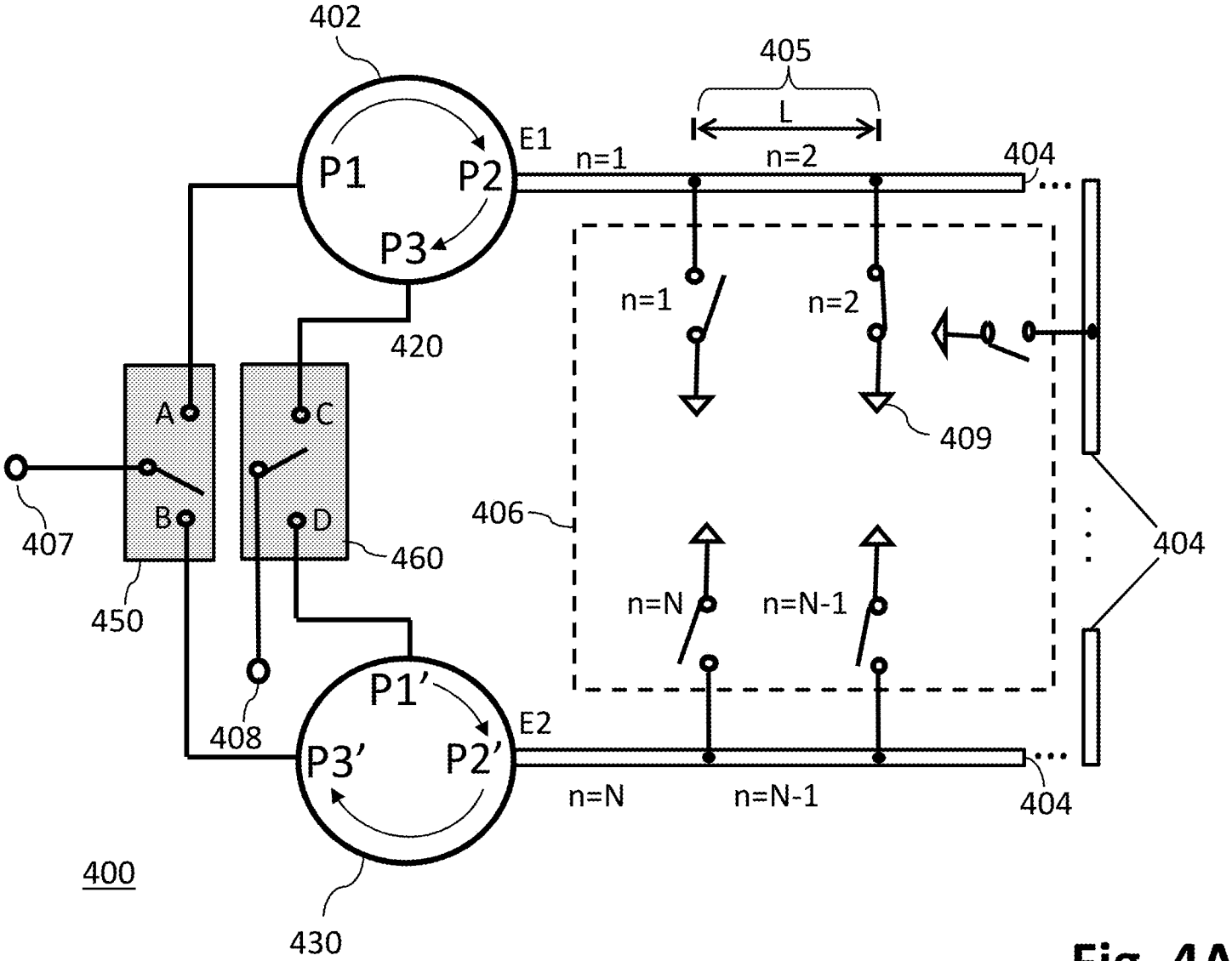
FIG. 4A is a diagram showing an example of a circulator-based tunable delay line in another embodiment.
Figure 4B:
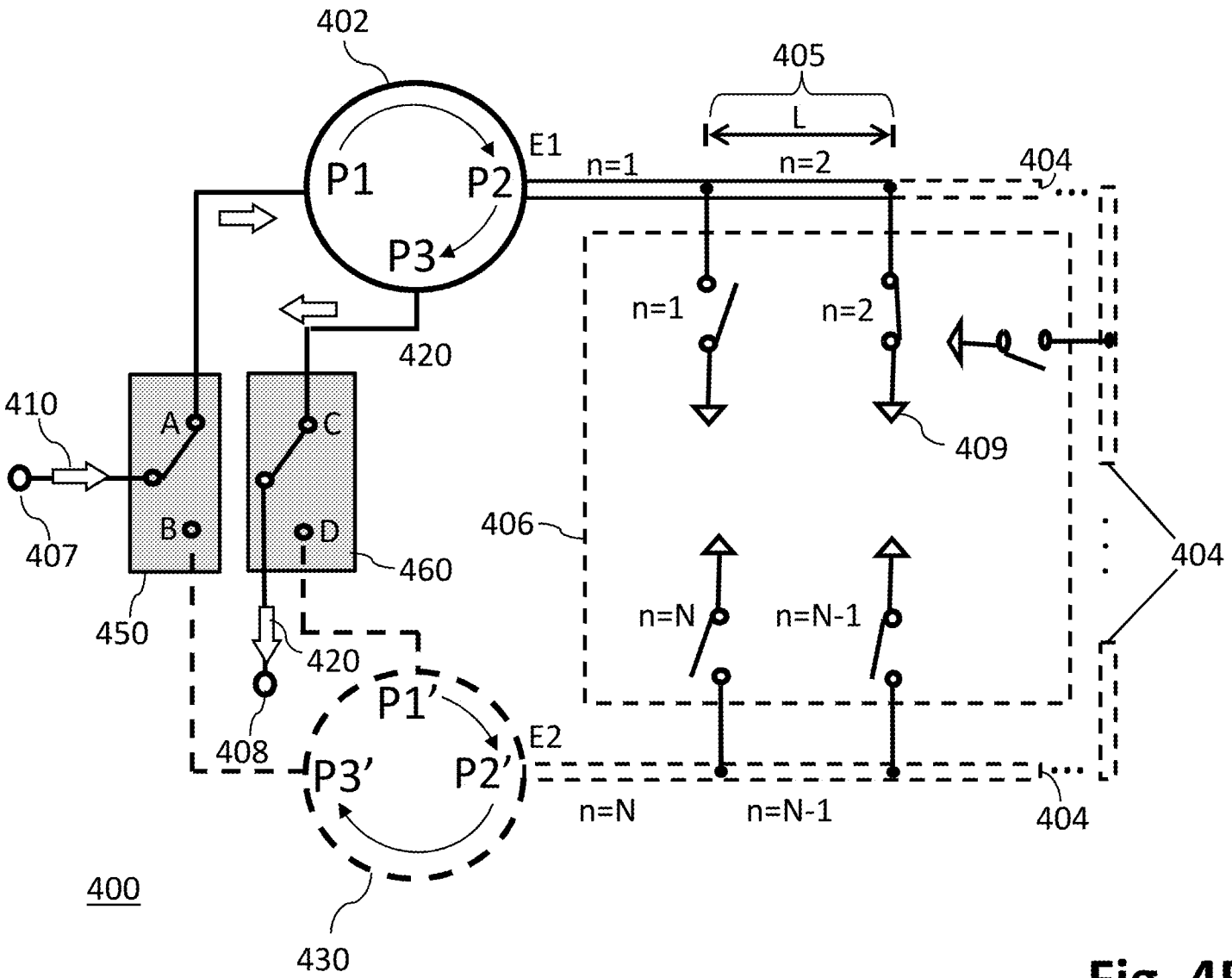
FIG. 4B is a diagram showing an example of a circulator-based tunable delay line in another embodiment.
Figure 4C:
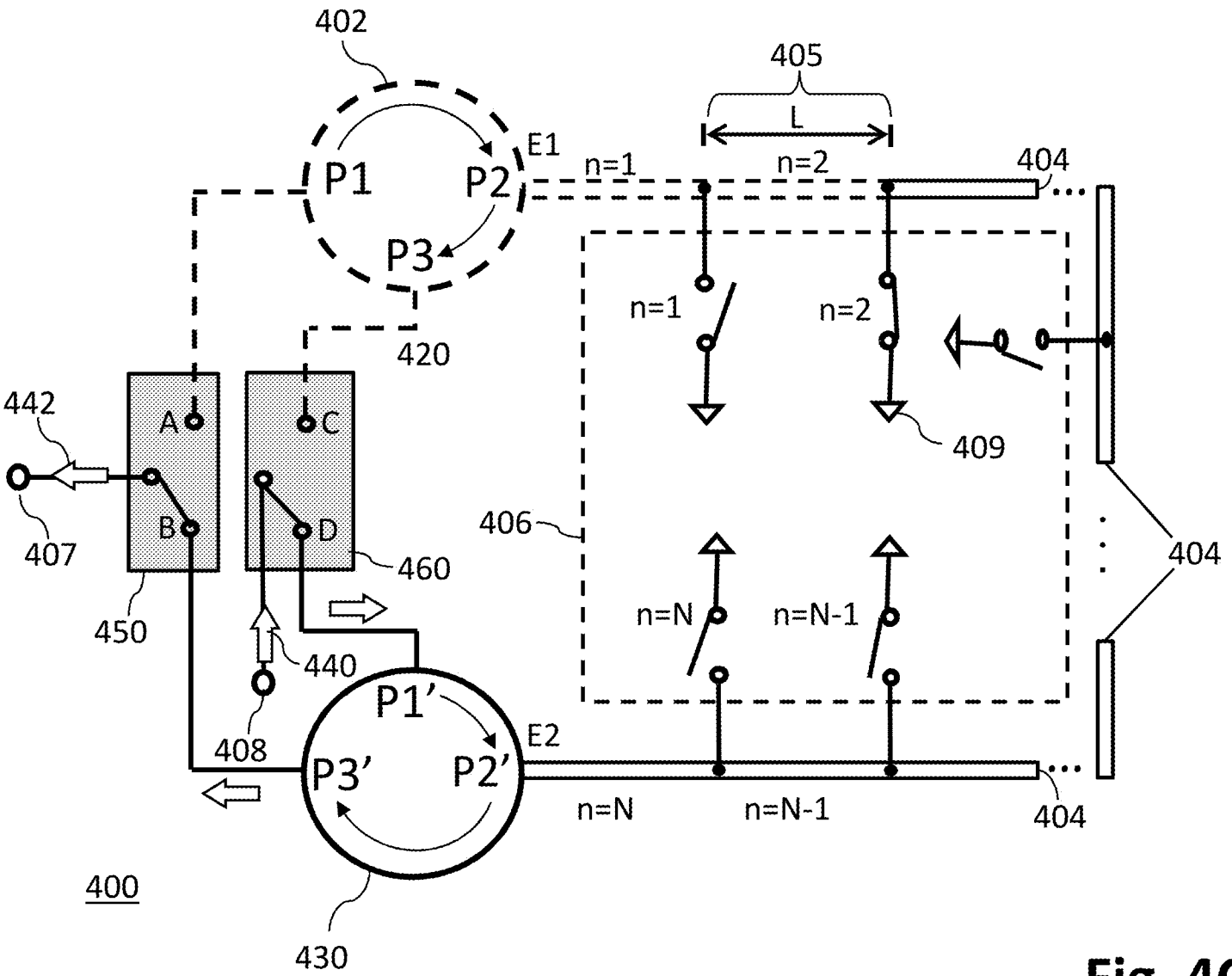
FIG. 4C is a diagram showing an example of a circulator-based tunable delay line in another embodiment.

FIGS. 4A, 4B, 4C are diagrams showing examples of a circulator-based tunable delay line in another embodiment. A structure 400 can be a time delay unit or structure implemented in a communication system or communication device. For example, the structure 400 can be implemented with a transceiver. In some examples, the structure 100 can be implemented as a part of a phase shifting apparatus with a communication device. The structure 400 can include a circulator 402, a circulator 430, a transmission line 404, and a plurality of circuit elements 406. In the example embodiment shown in FIG. 4A, the circuit elements 406 can include a plurality of shunt switches or switches (e.g., N switches) ranging from n=1 to n=N. The transmission line 404 can be a structure including a plurality of segments 405 (e.g., N segments) ranging from n=1 to n=N. Each circuit element or switch 406 can be connected to a respective segment 405 of the transmission line 404. The plurality of circuit elements or switches 406 can be connected to ground (or ground terminal) 409.

The circulator 402 can be a non-reciprocal device that can be implemented in a passive or active architecture, such as a three-port circulator device including a first port labeled as P1, a second port labeled as P2, and a third port labeled as P3. A signal applied to port P1 can be outputted by port P2, a signal applied to port P2 can be outputted by the port P3, and a signal applied to port P3 can be outputted by the port P1. The port P2 can be connected to a first end E1 of the transmission line 404. The circulator 430 can be a non-reciprocal device that can be implemented in a passive or active architecture, such as a three-port circulator device including a first port labeled as P1', a second port labeled as P2', and a third port labeled as P3'. A signal applied to port P1' can be outputted by port P2', a signal applied to port P2' can be outputted by the port P3', and a signal applied to port P3' can be outputted by the port P1'. The port P2' can be connected to a second end E2 of the transmission line 404.

In the example shown in FIG. 4A, the port P1 can be connected to a switch 450, where the switch 450 can be connected to a terminal 407. The terminal 407 can be connected to one or more components of a transceiver having the structure 400. For example, the terminal 407 can be connected to transmitting components such as modulators, transmitters, filters, digital-to-analog converters (DAC), encoders, power splitters, switches, etc. The terminal 407 can also be connected to receiving components such as demodulators, filters, analog-to-digital converters (ADC), decoders, power combiners, etc. The port P3 can be connected to a switch 460, where the switch 460 can be connected to a terminal 408. The terminal 408 can be connected to one or more components of a transceiver having the structure 400. The switch 450 can include a terminal A and a terminal B, and the switch 460 can include a terminal C and a terminal D. The port P1' can be connected to the terminal D of the switch 460, and the port P3' can be connected to the terminal B of the switch 450.

In examples where the structure 400 is a part of a transceiver, activation of the circulator 402 can activate a transmission mode of the transceiver (see FIG. 4B), and activation of the circulator 430 can activate a receiving mode of the transceiver (see FIG. 4C). The structure 400 can delay signals being transmitted by the transceiver and signals being received at the transceiver while using of the same transmission line 404. The structure 400 can provide flexibility in tuning different levels of delay and occupying relatively less area. Further, the structure 400 can be further implemented with circuit elements having different delay states, such as the circuit elements 206 and 306 shown in FIG. 2 and FIG. 3, respectively.

To facilitate a transmission using the structure 400, a transmission mode of the structure 400 can be activated. The activation of the transmission mode can include switching the switch 450 to terminal A and switching the switch 460 to terminal C, as shown in FIG. 4B. When the transmission mode is activated, the terminal 407 can be connected to the port P1 of the circulator 402 and the terminal 408 can be connected to the port P3 of the circulator 402. Note that the terminal B and the terminal D are not connected to the terminals 407 and 408, causing the circulator 430 to be inactive or deactivated. A signal 410 can be received at port P1 via the terminal 407 and the connection to terminal A. The signal 410 can be circulated to P2 such that the signal 410 can be outputted at the port P2 to the transmission line 404. The signal 410 can flow or propagate along the transmission line 404 in a direction away from the circulator 402. In an example, the switch 406 at n=2 among the N switches 406 can be activated. The activation of the switch at n=2 can form a closed signal path between the circulator 402 and the segment 405 at n=2, where the formed closed signal path can have a length of two segments. The signal 410 can be reflected from the segment 405 at n=2 and propagate towards the circulator 402 in a direction towards the circulator 402. The reflection of the signal 410 can be received by the port P2 and can be outputted at the port P3 as an output signal 420, where the output signal 420 is a delayed version of the signal 410. The output signal 420 can be outputted to another component or device (e.g., a power amplifier) via the connection to terminal C and the terminal 408 connected to the port P3.

To facilitate a reception of signals using the structure 400, a receiving mode of the structure 400 can be activated. The activation of the receiving mode can include switching the switch 450 to terminal B and switching the switch 460 to terminal D, as shown in FIG. 4C. When the receiving mode is activated, the terminal 407 can be connected to the port P3' of the circulator 430 and the terminal 408 can be connected to the port P1' of the circulator 430. Note that the terminal A and the terminal C are not connected to the terminals 407 and 408, causing the circulator 402 to be inactive or deactivated. A signal 440 can be received at port P1' via the terminal 408 and the connection to terminal D. The signal 440 can be circulated to P2' such that the signal 440 can be outputted at the port P2' to the transmission line 404. The signal 440 can flow or propagate along the transmission line 404 in a direction away from the circulator 430. In an example, the switch 406 at n=2 among the N switches 406 can be activated. The activation of the switch at n=2 can form a closed signal path between the circulator 430 and the segment 405 at n=2, where the formed closed signal path can have a length of N−2 segments. The signal 440 can be reflected from the segment 405 at n=2 and propagate towards the circulator 430 in a direction towards the circulator 430. The reflection of the signal 440 can be received by the port P2' and can be outputted at the port P3' as an output signal 442, where the output signal 442 is a delayed version of the signal 440. The output signal 442 can be outputted to another component or device via the connection to terminal B and the terminal 407 connected to the port P3'.

Figure 5:
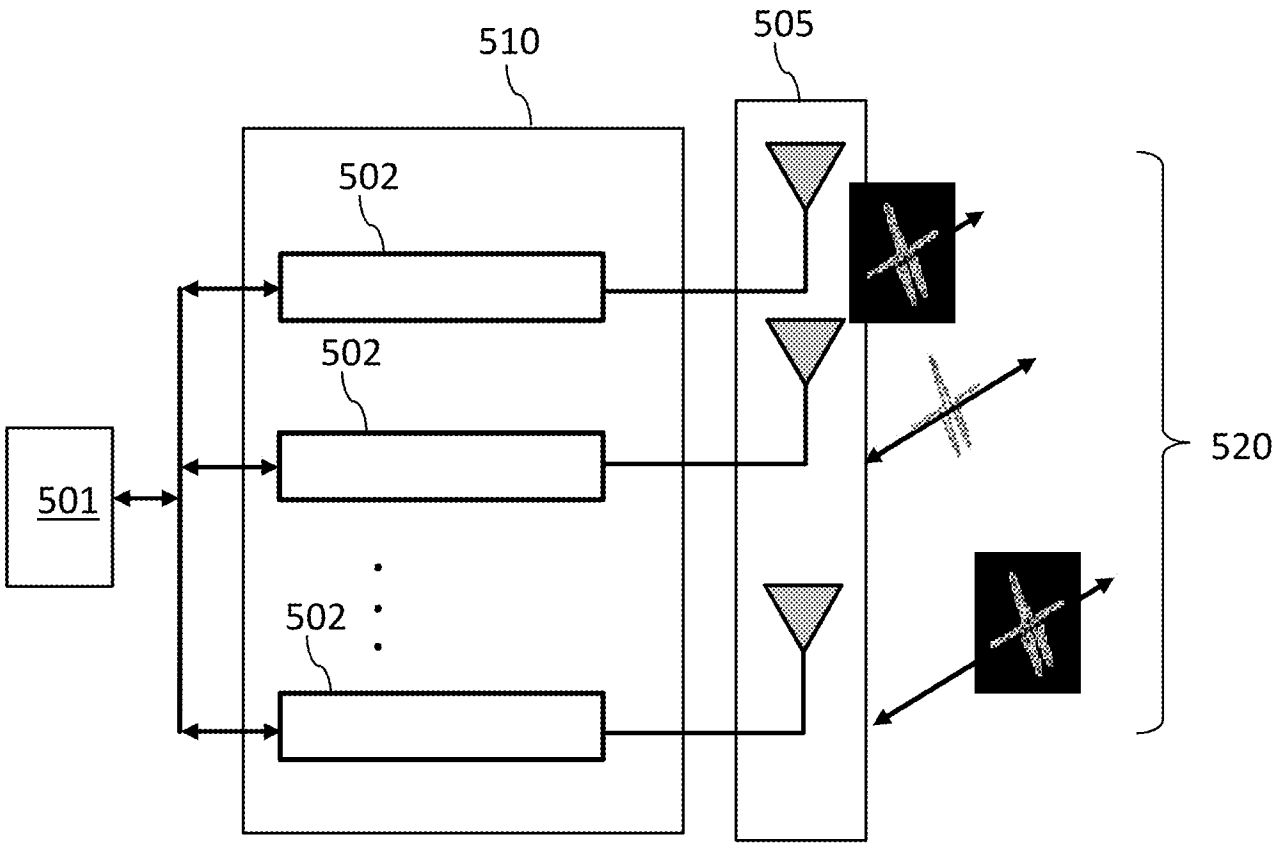
FIG. 5 is a diagram showing an example system that can implement a circulator-based tunable delay line in another embodiment.

FIG. 5 is a diagram showing an example system that can implement a circulator-based tunable delay line in another embodiment. In an example shown in FIG. 5, a system 500 can include a device 501, a device 510, and one or more antennas 505. The device 501 can be a communication device, such as a transceiver equipped with a transmitter and a receiver. The device 510 can include a plurality of structures 502. A structure 502 can be a time delay unit including at least one circulator, a transmission line, and a plurality of circuit elements. In some examples, the structure 502 can be one of the structures 100, 200, 300, 400 shown in FIGS. 1-4 and described herein. The device 510 can be implemented as a phase shifter or a phase shifting apparatus for the device 501. In an example, the device 510 can implement the structures 502 can be configured to delay one or more portions of a signal being transmitted by the device 501. The device 510 can provide the delayed version of the signals to the plurality of antennas 505. The antennas 505 can transmit the delayed signals as output signals 520 in the form of radio waves or beams. In an example, the device 510 can be configured to perform time delay and phase shifting on a broadband signal being transmitted by the device 501. In another example, the device 510 can implement the structures 502 to delay one or more portions of radio beams or signals received by the plurality of antennas 505. In yet another example, additional circuit elements such as amplifiers, matching networks, or switches are placed between the antennas 505 and each of the structures 502.

Figure 6:
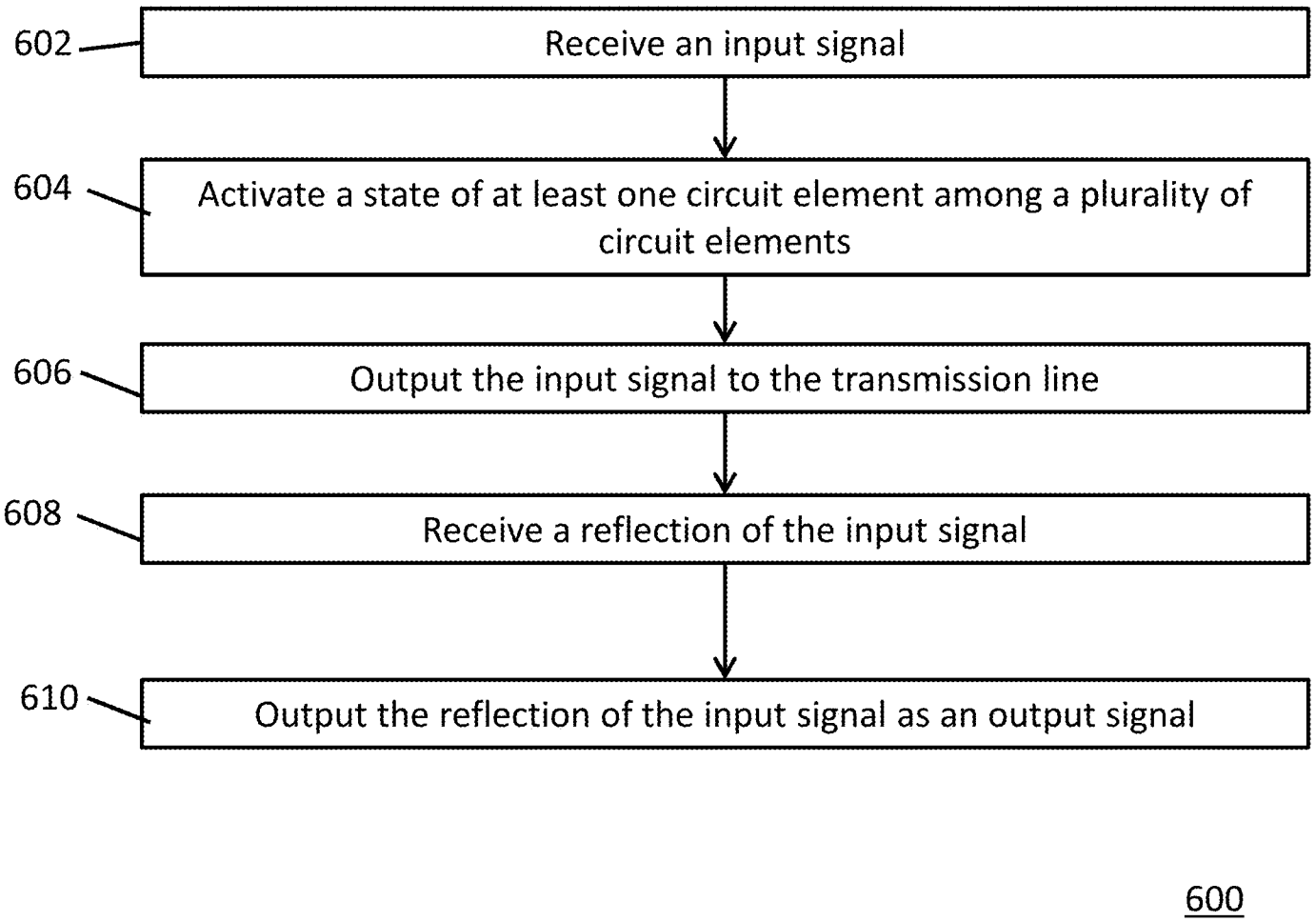
FIG. 6 is a flow diagram illustrating a method of implementing a circulator-based tunable delay line in one embodiment.

FIG. 6 is a flow diagram illustrating a method of implementing a process 600 and a circulator-based tunable delay line in one embodiment. An example process may include one or more operations, actions, or functions as illustrated by one or more of blocks 602, 604, 606, 608, and/or 610. Although illustrated as discrete blocks, various blocks can be divided into additional blocks, combined into fewer blocks, eliminated, or performed in parallel, depending on the desired implementation.

The process 600 can begin at block 602. At block 602, a device can receive an input signal. The process 600 can continue from block 602 to block 604. At block 604, the device can activate a state of at least one circuit element among a plurality of circuit elements. The plurality of circuit elements can be connected to a plurality of segments of a transmission line. The process 600 can continue from block 604 to block 606. At block 606, the device can output the input signal to the transmission line. The process 600 can continue from block 606 to block 608. At block 608, the device can receive a reflection of the input signal. A delay between the reflection and input signal can be based on the activated state of the at least one circuit element among the plurality of circuit elements. The process 600 can continue from block 608 to block 610. At block 610, the device can output the reflection of the input signal as an output signal.

In an example, the input signal can be received at a first port of a circulator, and the input signal can be outputted to the transmission line from a second port of the circulator. The reflection of the input signal can be received at the second port of the circulator, and the reflection of the input signal can be outputted from a third port of the circulator. In an example embodiment, the activation of the state of the at least one circuit element can include activating a switch among the plurality of circuit elements. The activated switch can be connected to a particular segment of the transmission line, where the delay can be twice the distance propagated by the input signal along the transmission line to the particular segment. In another example embodiment, the activation of the state of the at least one circuit element can include activating a first subset of the circuit elements to a first delay state, and activating a second subset of the circuit elements to a second delay state. In this embodiment, the delay can be based on a first number of circuit elements activated to the first delay state, and based on a second number of circuit elements activated to the second delay state.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be implemented substantially concurrently, or the blocks may sometimes be implemented in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements, if any, in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A structure comprising:

a circulator;

a transmission line connected to the circulator, the transmission line having a plurality of segments, wherein in response to a control signal being applied on a circuit element among a plurality of circuit elements, a closed signal path is formed between the circulator and a segment connected to the circuit element, and a first subset of segments are activated to a first delay state and a second subset of segments are activated to the second delay state; and a plurality of circuit elements connected to the plurality of segments;

the circulator being configured to:

receive an input signal; and output an output signal, wherein a delay between the input signal and the output signal is based on a first number of segments activated to the first delay state, and based on a second number of segments activated to the second delay state.

2. The structure of claim 1, wherein the circulator is a three-port circulator comprising a first port, a second port, and a third port.

3. The structure of claim 2, wherein:

the input signal is received at the first port;

the transmission line is connected to the second port; and the output signal is outputted from the third port.

4. The structure of claim 1, wherein:

the plurality of circuit elements comprises a plurality of switches connected to ground;

the control signal activates a switch among the plurality of switches; and the delay is further based on a distance between the circulator and the segment connected to the activated switch.

5. The structure of claim 1, further comprising a controller configured to generate the control signal, wherein:

the plurality of circuit elements are connected to the controller;

the control signal comprises a first control signal and a second control signal;

the first control signal activates the first delay state of the first subset of the plurality of segments; and the second control signal activates the second delay state of the second subset of the plurality of segments.

6. The structure of claim 1, wherein:

the circulator is a first circulator connected to a first end of the transmission line;

the structure further comprises a second circulator connected to a second end of the transmission line;

the input signal received by the first circulator is a first input signal;

the output signal outputted by the first circulator is a first output signal;

in response to connecting the first circulator to a first terminal that received the first input signal, the first input signal propagates in a first direction from the first end of the transmission line to the second end of the transmission line;

in response to connecting the second circulator to a second terminal, the second circulator being configured to:

receive a second input signal via the second terminal, wherein the second input signal propagates in a second direction from the second end of the transmission line to the first end of the transmission line; and output a second output signal, wherein a delay between the second input signal and the second output signal is based on the control signal being applied on the circuit element among the plurality of circuit elements.

7. A system comprising:

a first device;

a plurality of antennas;

a second device configured to be in communication with the first device, the second device comprises a plurality of structures, and a structure comprises:

a circulator;

a transmission line connected to the circulator, the transmission line having a plurality of segments; and a plurality of circuit elements connected to the plurality of segments;

the circulator being configured to:

receive an input signal from the first device;

output an output signal to the plurality of antennas via the transmission line, wherein a delay between the input signal and the output signal is based on a control signal being applied on a circuit element among the plurality of circuit elements, and a closed signal path is formed between the circulator and a segment connected to the circuit element in response to the control signal being applied on the circuit element; and the plurality of antennas is configured to transmit the output signal as radio beams.

8. The system of claim 7, wherein the circulator is a three-port circulator comprising a first port, a second port, and a third port.

9. The system of claim 8, wherein:

the input signal is received at the first port;

the transmission line is connected to the second port; and the output signal is outputted from the third port.

10. The system of claim 7, wherein:

the plurality of circuit elements comprises a plurality of switches connected to ground;

the control signal activates a switch among the plurality of switches; and the delay is twice the distance between the circulator and the segment connected to the activated switch.

11. The system of claim 7, wherein the second device further comprises a controller configured to generate the control signal, wherein:

the plurality of circuit elements are connected to the controller;

the control signal comprises a first control signal and a second control signal;

the first control signal activates a first delay state of a first subset of the plurality of segments;

the second control signal activates a second delay state of a second subset of the plurality of segments; and the delay is based on a first number of segments activated to the first delay state, and based on a second number of segments activated to the second delay state.

12. The system of claim 11, wherein:

the plurality of circuit elements are connected to a plurality of switches connected to ground;

the control signal further comprises an activation signal to activate a switch among the plurality of switches; and the delay is further based on a distance between the circulator and the segment connected to the activated switch.

13. The system of claim 7, wherein:

the circulator is a first circulator connected to a first end of the transmission line;

the second device further comprises a second circulator connected to a second end of the transmission line;

the input signal received by the first circulator is a first input signal;

the output signal outputted by the first circulator is a first output signal;

in response to connecting the first circulator to a first terminal that received the first input signal, the first input signal propagates in a first direction from the first end of the transmission line to the second end of the transmission line;

in response to connecting the second circulator to a second terminal, the second circulator being configured to:

receive a second input signal via the second terminal, wherein the second input signal propagates in a second direction from the second end of the transmission line to the first end of the transmission line; and output a second output signal, wherein a delay between the second input signal and the second output signal is based on the control signal being applied on the circuit element among the plurality of circuit elements.

14. A method for delaying an input signal, the method comprising:

receiving an input signal;

activating a circuit element among a plurality of circuit elements, wherein the plurality of circuit elements are connected to a plurality of segments of a transmission line, wherein in response to activating the circuit element, a first delay state of a first subset of segments among the plurality of segments is activated, and a second delay state of a second subset of segments among the plurality of segments is activated;

outputting the input signal to the transmission line;

receiving a reflection of the input signal from a segment connected to the activated circuit element, wherein a delay between the reflection and input signal is based on a first number of segments activated to the first delay state, and based on a second number of segments activated to the second delay state, and a closed signal path is formed between the segment connected to the activated circuit element and a circulator connected to the transmission line; and outputting the reflection of the input signal as an output signal.

15. The method of claim 14, wherein:

the input signal is received at a first port of the circulator;

the input signal is outputted to the transmission line from a second port of the circulator;

the reflection of the input signal is received at the second port of the circulator; and the reflection of the input signal is outputted from a third port of the circulator.

16. The method of claim 14, wherein activating the circuit element comprises activating a switch among the plurality of circuit elements, and the delay is based on a distance propagated by the input signal along the transmission line to the segment.

* * * * *